United States Patent [19]

Gunkel et al.

[11] Patent Number: 4,947,667

[45] Date of Patent: Aug. 14, 1990

[54] METHOD AND APPARATUS FOR REFORMING A CONTAINER

[75] Inventors: Ronald W. Gunkel, Lower Burrell; Robert A. Cargnel, Export; James R. Morran, Apollo; Edward P. Patrick, Murrysville, all of Pa.

[73] Assignee: Aluminum Company of America, Pittsburgh, Pa.

[21] Appl. No.: 472,020

[22] Filed: Jan. 30, 1990

[51] Int. Cl.[5] ..... B21D 26/14

[52] U.S. Cl. ..... 72/56; 72/430; 72/707; 29/419.2

[58] Field of Search ..... 72/54, 56, 57, 707, 72/430; 29/419.2; 336/59, 222, 223

[56] References Cited

U.S. PATENT DOCUMENTS

| | | | |
|---|---|---|---|
| 3,288,006 | 11/1966 | Erlandson | 72/56 |
| 3,372,566 | 3/1968 | Schenk et al. | 72/56 |
| 3,461,699 | 8/1969 | Roth | 72/56 |
| 3,555,867 | 1/1971 | Schwinghamer | 72/56 |
| 3,599,461 | 8/1971 | Astl | 72/56 |
| 3,599,462 | 8/1971 | Kline | 72/56 |
| 3,618,350 | 11/1971 | Larrimer, Jr. | 72/56 |
| 3,810,372 | 5/1974 | Queyroix | 72/56 |
| 4,285,224 | 8/1981 | Shkatov | 72/56 |
| 4,619,127 | 10/1986 | Sano et al. | 72/56 |

*Primary Examiner*—David Jones

*Attorney, Agent, or Firm*—William J. O'Rourke, Jr.; Elroy Strickland

[57] ABSTRACT

This invention provides a method for expanding at least a portion of a cylindrical sidewall of a generally cylindrically shaped, electrically responsive, metallic body. This method comprises the steps of retaining at least a first portion of the metallic body, disposing a coil of electrically conductive material inside the metallic body, and energizing the coil to create an electromagnetic force sufficient to expand at least a portion of the generally cylindrical sidewalls of the metallic body outwardly of the original generally cylindrical shape. During such expansion, a fluid is introduced between the coil and the inside surfaces of the container to maintain positive gauge pressure as the sidewalls expand. This invention also provides an apparatus for expanding at least a portion of a cylindrical sidewall of a generally cylindrically shaped, electrically responsive, metallic body. The apparatus comprises a retaining mechanism for holding the metallic body, a coil of electrically conductive material, structure for disposing the coil inside the metallic body, and structure for energizing the coil sufficient to expand at least a portion of the sidewall of the metallic body. Means for maintaining positive gauge pressure during expansion is also included in the apparatus.

40 Claims, 3 Drawing Sheets

METHOD AND APPARATUS FOR REFORMING A CONTAINER

BACKGROUND OF THE INVENTION

1. Field of the Invention

This invention pertains to a method and an apparatus for reforming electrically responsive articles and more particularly to a method and apparatus for electromagnetically reforming at least a portion of the sidewalls of generally cylindrically shaped containers.

2. Description of the Art

Various methods are known in the art for shaping articles such as metallic containers. U.S. Pat. No. 1,711,445, for example, discloses a method in which a plunger and compressed air cooperate to bulge container sidewalls against the face of an adjacent die. U.S. Pat. No. 2,787,973 pertains to a method for hydraulically expanding a container into tight contact with a surrounding mold. High voltage discharge forming of containers against a fixed mold is described, for example, in U.S. Pat. No. 3,654,788. These and other methods result in reforming the sidewalls of thin walled containers to conform to a mold configuration against which the sidewalls are directed.

Another working method known in the art is called magnetic forming or electromagnetic forming. Such a method involves forming materials with the use of magnetic fields of relatively high intensity. In electromagnetic forming an electrical current is passed through a coil consisting of a conductive wire which is typically supported by a nonconductive structure. The current produces a pulsed magnetic field which induces a current in an adjacent conductive workpiece. The induced current in the workpiece reacts with the magnetic field to produce a force which is directed against the adjacent workpiece. An exemplary electromagnetic forming coil is described in U.S. Pat. Nos. 3,383,890 and 3,599,461.

Electromagnetic forming has been employed in a number of various applications. For example, U.S. Pat. No. 3,540,250 discloses the use of a magnetomotive coil used to constrict large diameter metal tubes, and U.S. Pat. No. 4,285,224 pertains to the use of an electric pulse to expand tubes such as those employed in heat exchangers. Other applications for electromagnetic forming include reinforcing lock seams by expanding metallic locking bands.

A method of magnetomotive forming of cylindrical objects such as cans is disclosed in U.S. Pat. No. 3,810,373. This method involves subjecting the object to a very high outwardly directed force wherein the object is compressed against a surrounding die. An exemplary die, described in U.S. Pat. No. 3,810,372, is for forming selected impressions in the cylindrical object.

Despite prior work in the electromagnetic area, there is still a need for further improvement to provide a method and an apparatus for electromagnetically reforming container bodies which are not cumbersome, not excessively expensive and do not tend to unduly restrict the demand for high production rates.

SUMMARY OF THE INVENTION

This invention may be summarized as providing a method for expanding at least a portion of a cylindrical sidewall of a generally cylindrically shaped, electrically responsive, metallic body. This method comprises the steps of retaining at least a first portion of the metallic body, disposing a coil of electrically conductive material inside the metallic body, and energizing the coil to create an electromagnetic force sufficient to expand at least a portion of the generally cylindrical sidewalls of the metallic body outwardly of the original generally cylindrical shape. During such expansion, a fluid is introduced between the coil and the inside surfaces of the container to maintain positive gauge pressure as the sidewalls expand.

This invention is also summarized as providing an apparatus for expanding at least a portion of a cylindrical sidewall of a generally cylindrically shaped, electrically responsive, metallic body. The apparatus comprises a retaining means for holding the metallic body, a coil of electrically conductive material, means for disposing the coil inside the metallic body, and means for energizing the coil sufficient to expand at least a portion of the sidewall of the metallic body. Means for maintaining positive gauge pressure in the fluid during expansion is also included in the apparatus.

Among the advantages of this invention is the provision of a can reforming operation which utilizes the high force of electromagnetic energy to bulge a can sidewall without requiring external dies to restrict, absorb or direct the extent of the outward bulge.

Another advantage of this invention is an apparatus for producing shaped metallic containers at high production rates.

A feature of the apparatus of this invention is that a coil of electrically conductive material is energized sufficiently to expand the sidewalls of a container without the use of forming dies.

Another feature of this invention is that shaped containers, having outward bulges in the sidewalls of various shape and location, may be produced by a viable high production rate manufacturing process.

An objective of this invention is to provide a method of producing containers having specific shapes by designing an electromagnetic coil in a fashion that controls the electromagnetic forces thereby eliminating the necessity for a shaping die.

In addition to increased consumer satisfaction and the pleasing aesthetics associated with shaped cans, the outwardly bulged cans formed by this invention have increased volume over straight cylindrical cans of the same height and may be easier to hold or grip within the palm of the hand.

These and other objects and advantages of the invention will be more thoroughly understood and appreciated with reference to the following description and the accompanying drawings.

DETAILED DESCRIPTION

The present invention is directed to a method and apparatus for reforming containers. The containers which may be reformed by this invention generally include cylindrical cans. Such cans include steel, aluminum or other electrically responsive metallic bodies, which may be coated with various protective coatings, or decorated before and/or after the reforming operation. Electrically responsive cans are those which respond to electromagnetic force directed thereagainst by expansion in a direction away from the force. Preferred containers for this invention include steel, tinplate and aluminum food cans, beer and beverage cans and other metallic, straight cylinder rigid packages of various diameter and height, as well as polymer-aluminum, and polymer-steel laminate containers.

The present invention provides a method for reforming at least a portion of a sidewall of a generally straight cylinder can into a can having an outward circumferential bulge or a plurality of outward bulges in the sidewall.

Figure 1:
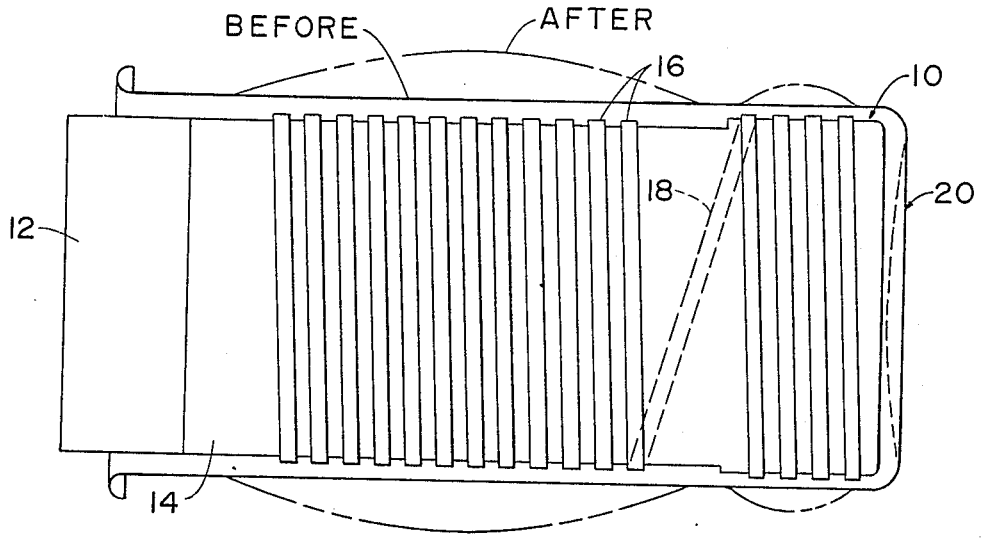
FIG. 1 is an elevation view of a coil of wound electrically conductive material.
Figure 2:
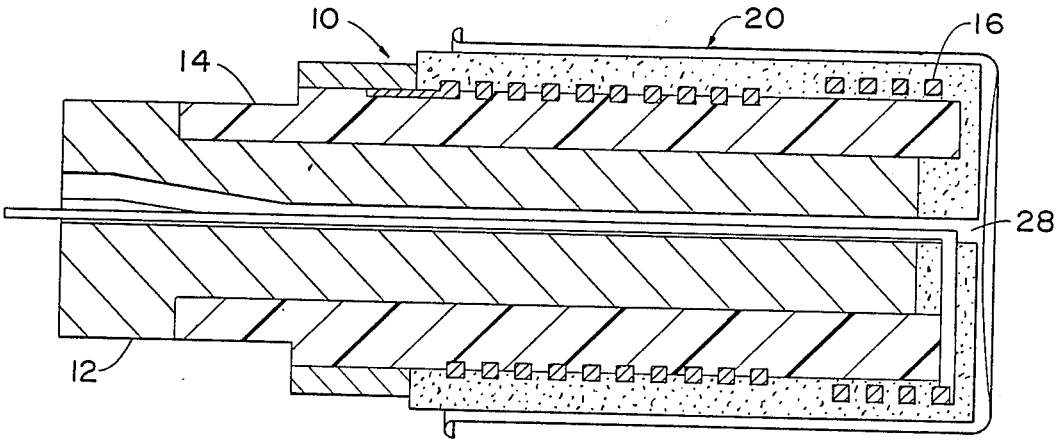
FIG. 2 is a cross-sectional view of the coil shown in FIG. 1.

Referring particularly to the drawings, FIGS. 1 and 2 illustrate a coil 10 of the present invention. The coil 10 is used to exert electromagnetic force, as explained below. In a preferred embodiment, the coil 10 has a hollow aluminum central conductor or core 12. The core 12 acts as a structural backbone for the coil and provides both mechanical and electrical connections to a capacitor power supply, not shown. In certain embodiments and applications the core may not be required to provide electrical connections, but may be required for structural purposes.

In a preferred embodiment, such as that shown in FIG. 2, an insulating layer 14 is provided around the outside surface of the conductor core 12 at least in those regions where a wire 16 is to be wound. Care must be taken to assure that the current does not shunt between adjacent coil turns. Alternatively, the wire 16 to be wound may be insulated which may obviate the necessity to provide separate insulating layer 14. The wire 16 is wound about the core 12. A preferred wire is an insulated, square copper conductor, such as No. 6 gauge copper wire. Such preferred wire produces a stronger, more uniform magnetic force as compared to round wire. The generation of a uniform magnetic force is important in preventing surface irregularities in bulged sidewalls of a container as is explained below. In the embodiment shown in FIG. 2 an insulative nonconducting or nonmagnetic material may be provided about the wire, such as a ceramic material. This embodiment provides a coil in which the conductor is protected, yet the electromagnetic force is not adversely affected in the practice of this invention.

Figure 3:
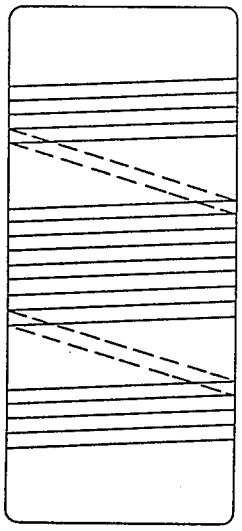
FIGS. 3–5 are elevation views of alternative coils of this invention.
Figure 4:
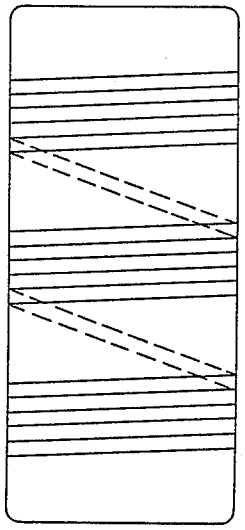
Figure 5:
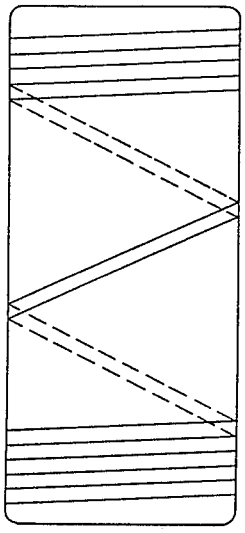

The conductive wire is wound with consideration for the area where electromagnetic force is desired. By controlling the number of conductive turns per unit of length and/or the coil current, and/or the distance from the conductive wire to the container wall, the amount of electromagnetic force can be varied along the coil. As shown in the embodiment of FIG. 2, there are two separate regions of close conductor windings. Region 1 is located at one end of the coil and provides a region which when energized in proper position generates a concentrated magnetic force to bulge the sidewalls of a bottom portion of a can body as described below. Region 2 is located centrally of the coil and provides a separate region which when energized in proper position generates a concentrated magnetic force to bulge the sidewalls of a central portion of a can body. Such sidewalls typically have a thickness of about 0.002 to 0.030 inch. The two regions are typically electrically connected through a single conductor winding, such as winding 18 shown in FIG. 1. It will be appreciated that various conductor winding patterns may be utilized in the present invention, including a number of regions of various length along the coil 10. FIGS. 3–5 illustrate alternative coil winding patterns which may be utilized in this invention.

Figure 6:
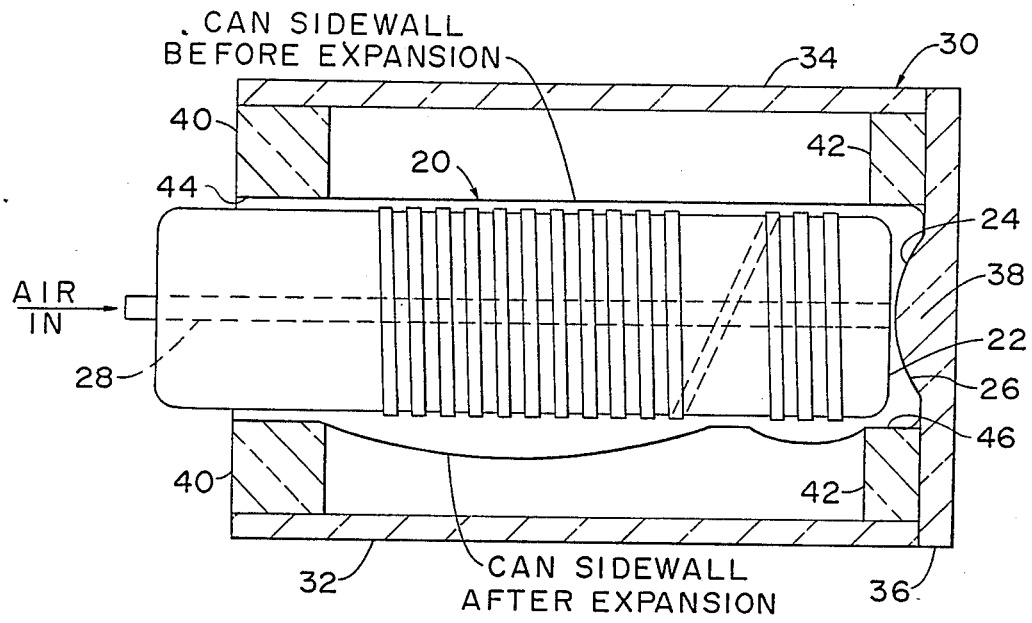
FIG. 6 is a view of a preferred apparatus of the present invention partially in cross section showing a can sidewall before and after outward expansion thereof.

In the present invention, the coil 10 is inserted into a can body 20, such as is shown in FIG. 6. The coil 10 should be disposed such that the coil winding regions are disposed adjacent the areas of the can body which are to be bulged by the process of this invention. Placement of the coil 10 inside the can body 20 may be accomplished consistently and repetitively by a number of methods. For example, the coil 10 may be disposed into the can body 20 until an end wall 22 of the core 12 abuts a portion of the inside surface 24 of the can bottom 26. In beer and beverage can applications the bottom end wall 26 of the can body 20 is domed inwardly. Such bottom dome may serve as an ideal backstop for consistently and repetitively positioning the core, and thus the conductor windings, at an appropriate location within a can body. Whatever positioning device may be employed, care may be taken to assure that passageway 28 is not impeded, for reasons explained below.

In addition to the winding pattern electromagnetic force is also dependent upon the spacing of the conductor from the inside surface of the can sidewalls to be bulged. Such conductor-to-can distance may be varied alone or in combination with varying the electrical power to control the extent of outward bulge of the can sidewalls. It is preferred to keep the conductor-to-can distance as small as practicable to localize the bulge and minimize power requirements. It is noted that electromagnetic force varies inversely with an exponential function of the distance. Along these lines, conductor-to-can distances of about 0.050 inch, and more particularly from about 0.001 to 0.010 inch, are prefered. In certain instances, such as where the open end portion of a container to be bulged has been necked inwardly, such small preferable conductor-to-can distances may not be achievable.

The coil 10 is disposed within a can body 20 with small conductor-to-can distance. In order to minimize or eliminate sidewall wrinkling during bulging, there must be sufficient venting of the gap between the coil and the sidewall of the can body. Venting may be insured, especially with very close conductor-to-can distances, by maintaining positive gauge pressure throughout the bulging operation. One exemplary method of maintaining positive gauge pressure is to introduce air through a passageway 28 in the core 12 of the coil 10 in sufficient volume to assure a positive gauge pressure. In a preferred embodiment, such as that illustrated in FIG. 2, leads of the conductor 16 may pass through the passageway 28 and radially outwardly therefrom to be helically wrapped about the insulating layer 14. It as been found that a positive gauge pressure may be obtained and maintained with a relatively loose, yet restrictive, seal between the coil and the generally cylindrical container. In any event, it has been found that such seal need not be air tight to maintain a positive gauge pressure during bulging; it merely has to be tight enough to assure that the amount of gas escaping is less than the amount of gas being introduced. It has been found that gas flow through a restrictive seal provides positive gauge pressure while also providing beneficial coil cooling.

An open, holding fixture or assembly 30 is illustrated in FIG. 6. By "open" it is meant that there are no walls in the fixture against which portions of the sidewall of the container are bulged, or which restrict or interfere with outward deformation of the sidewall during the forming operation. It will be appreciated that lateral end portions of the container may be held during the bulging operation. But the outward deformation of the sidewalls is unrestricted in the shaping process of this invention.

The holding fixture 30 shown in FIG. 6 includes outside walls 32 and 34 and an end wall 36. End wall 36 may be provided with an inwardly projecting rib 38 generally matching the contour of the domed bottom end wall 26 of the can body 20 to be positioned within the fixture 30. The fixture 30 also includes a first ring 40 and a second ring 42 having inside faces 44 and 46 respectively defining the inside diameter of the rings 40 and 42. The inside faces 44 and 46 provide locations where lateral end portions of a container may seat, rest and maintain their critical dimensions during the bulging operation of this invention. Preferably, the inside diameter of the inside faces 44 and 46 are substantially equal to the outside diameter of the upper and lower end portions of the container to be bulged by the process of this invention.

Preferably, the fixture is a two-piece assembly which can be readily opened and closed to position and remove a container before and after electromagnetic shaping. The fixture is fabricated from a nonmetallic material to prevent surface defects that might occur due to arcing between a metallic container and die assembly materials. One exemplary material for the fixture is epoxy fiberglass, although other plastic or ceramic materials may be utilized.

In the method of electromagnetically expanding the sidewalls of a generally cylindrically shaped portion of a metallic can 20, the can 20 is first positioned appropriately inside the fixture 30. Preferably, at least a first portion, such as a lower portion of the can body adjacent the bottom wall, or bottom dome 26 of a container, is positioned. As shown in FIG. 6, the lower portion of a can body rests against a mating rib 38 in a fixture 30, and the bottom edge of the can sidewall seats inside a ring 42. Proper seating as well as the ability to repetitively seat can bodies in the proper position is important in controlling the can shaping process, particularly at high speeds. In one preferred embodiment, the fixture 30 is comprised of several pieces or components which open, such as by hinging the multiple pieces. When open, a container body may be seated in the assembly. Upon closing of the multiple pieces, the ring portions 40 and 42 would close, thereby bringing the inside surfaces 44 and 46, respectively, of the ring portions into contact with outside surfaces of the upper and lower portions of the container to be bulged.

With the container retained in proper position, a coil 10 of electrically conductive material is disposed into the container body through the open top portion of the container. Since repeatability is an important aspect of this invention, the proper positioning of the outside surface of the windings of the coil 10 with respect to the inside surface of the container sidewall to be bulged may be insured from container to container by providing a positioning mechanism such as a stop mechanism. In FIG. 6, the peripheral wall 22 of the core 12 may serve as such a stop mechanism. By inserting the coil 10 into each container 20 until the end wall 22 of the core 12 touches a portion of the domed inside surface of the container bottom 26, such repeatability may be insured. It will be appreciated that alternative positioning devices and stop mechanisms may be employed in this invention to assure that the coil windings are appropriately positioned without interruption with the proper functioning of the present invention.

It is also desirable to maintain close conductor-to-can distances. Therefore, the clearance between the outside surface of the conductor wire 16 and the inside surface of the can body 20 is typically less than 0.010 inch. Precautions are desirable to prevent conductor to container contact during the disposition of the coil 10 inside the container. Such precautions include the use of automated, precise positioning devices and/or layers of electrical insulating material over the conductor wire 16.

With the coil 10 positioned inside the container body, the coil 10 is energized to create an electromagnetic force sufficient to expand at least a portion of the sidewall of the metallic container 20 outwardly into an unrestricted area. A twelve kilojoule (kJ) of capacitor power supply, capable of producing approximately ten kilohertz of electromagnetic wave frequency has been utilized to develop this invention. Any power supply able to produce a minimum electromagnetic pulse energy of about 4 kJ at a minimum frequency of three kilohertz may be employed.

Energy on the order of about 1 to 4 kJ has been found to be successful to bulge the 0.004 to 0.010 inch thick sidewalls of aluminum container bodies having a diameter of about 2–3 inches. Perhaps there is a minimum container diameter into which a coil of suitable induction capacity could not be inserted; otherwise, there does not appear to be a limitation on size, wall thickness or diameter of container body to which the method of this invention applies. Of course, those skilled in the art will appreciate that containers having wall thickness or diameters varying significantly from the examples contained in this application may require a different electromagnetic energy input, but the principles of this invention still apply. Also, a higher frequency may be utilized to reduce energy losses by way of electromagnetic field penetration through a thin metallic container.

When appropriately energized, the coil 10 induces a very short duration current pulse of energy in the container sidewall. The pulse interacts with the coil generated magnetic field to create sufficient electromagnetic energy to bulge the adjacent sidewall of the container without otherwise contacting the sidewall. In the process of the present invention, this shaping process is conducted in an open fixture or assembly, i.e., no female dies are utilized. Fixtures without dies allow increased production rates, and minimize the potential for defects from blemished dies and entrapped air.

During the bulging process of this invention, a fluid is introduced between the coil and the inside surface of the metallic container to assure that positive gauge pressure is maintained during expansion of the sidewall of the container. Internally pressurizing the container during shaping eliminates wrinkling which could otherwise occur; i.e., without internal pressurization, a partial vacuum could be formed by the rapid increase in the circumference of selected portions of the container by the outward deformation of its sidewalls. Therefore, there must be sufficient fluid fed into the gap between the container and the coil to overcome the vacuum effects of the outward bulging of the sidewalls. Generally, introducing a gas into the coil-to-container gap at a rate of at least 70 psi is sufficient to eliminate wrinkling. In the embodiment illustrated in FIG. 6, positive gauge pressure is maintained by introducing gas pressure of approximately 90 to about 100 psi through a preferred longitudinal passage 28 through a central axis of the coil core 12.

A preferred fluid for use in this method is air because of availability, accessibility and its cooling effect on the coil. Other fluids comprehended by this invention include, but are not limited to, nitrogen, carbon dioxide, argon, helium and mixtures thereof. Of course, it will be appreciated that the fluid may be refrigerated to increase the coil cooling effects.

It may be desirable to partially anneal predetermined regions of the container prior to bulging. Such anneal controls mechanical properties for enhanced formability. An exemplary process for partially annealing containers is described in commonly assigned copending U.S. Patent Application Serial No. 472,025, filed Jan. 30, 1990 entitled Method for Partially Annealing the Sidewall of a Container, the contents of which are incorporated herein by reference.

Figure 7:
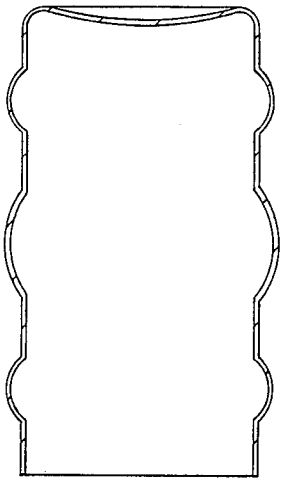
FIGS. 7–9 show cross sectional views of bulged cans which may be formed using the coils illustrated in FIGS. 3–5, respectively.
Figure 8:
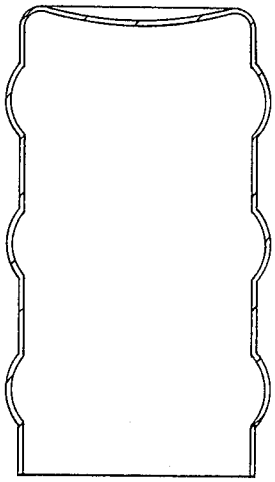
Figure 9:
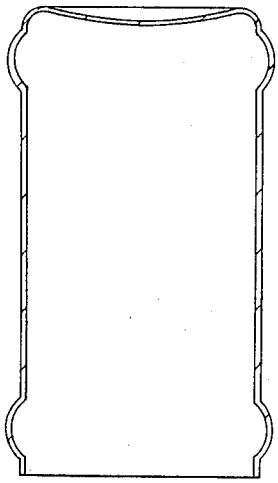

Various shaped containers may be formed by the process of this invention. FIGS. 3 to 5 illustrate exemplary coils which may be used to selectively bulge container sidewalls for the configurations shown in FIGS. 7 to 9, respectively. Various alternative configurations with single or multiple bulges are comprehended by this invention. It appears that the maximum bulge of the process of this invention is an increase in the diameter of a can by up to 20% depending, of course, on the alloy and the temper. For a 300x208, 5042 alloy food can having a diameter of about 3 inches, a single, central bulge to a diameter of about 3.3 inches is readily attainable. In bulging to such an extent, a container sidewall may experience thinning at the maximum diameter of the sidewall of up to about 10% especially when container height is maintained. The resulting can wall thinning is numerically equivalent to the amount of bulge expansion, e.g., a 5% expansion results in approximately a 5% wall reduction.

Bulged containers of this invention have been found to accommodate vacuums for food applications, internal pressures for beverage applications, retain column load and exhibit adequate base pressure buckle strengths.

What is believed to be the best mode of the invention has been described above. It will be apparent to those skilled in the art that numerous variations of the illustrated details may be made without departing from the scope of this invention.

We claim:

1. A method for outwardly expanding a sidewall of a generally cylindrically shaped portion of an electrically responsive, metallic body, comprising the steps of:

retaining at least a first portion of the metallic body, disposing a coil of electrically conductive material inside the retained metallic body with the outer diameter of the coil adjacent inside surfaces of a portion of the sidewall to be expanded, energizing the coil to create an electromagnetic force sufficient to expand at least a portion of the sidewall of the metallic body adjacent the coil outwardly of the original generally cylindrical shape in an unrestricted area, and introducing a fluid between the coil and the inside surface of the metallic body during expansion of the sidewall to maintain at least positive gauge pressure throughout expansion of the sidewall.

2. A method as set forth in claim 1 wherein the coil disposed inside the metallic body comprises at least one conductor winding portion having at least one turn.

3. A method as set forth in claim 1 wherein the coil comprises at least two conductor winding portions each having at least one turn electrically connected to one another by the conductor.

4. A method as set forth in claim 1 wherein the coil comprises a conductor wrapped on a structural core member.

5. A method as set forth in claim 1 wherein the metallic body is retained during expansion at a first portion substantially around the circumference of the base of the body and at a second portion substantially around the circumference of an upper portion of the body.

6. A method as set forth in claim 1 wherein positive gauge pressure is maintained by introducing a gas between the coil and the inside surfaces of the metallic body at a pressure of at least 70 pounds per square inch.

7. A method as set forth in claim 6 wherein the gas utilized to maintain positive gauge pressure is selected from the group consisting of air, nitrogen, carbon dioxide, argon and helium.

8. A method as set forth in claim 1 wherein positive gauge pressure is maintained by introducing gas pressure of from about 90 to 100 pounds per square inch through a longitudinal passage in the coil while maintaining a restrictive seal about an open end of the metallic body.

9. A method as set forth in claim 1 wherein a bottom end portion of a cup-shaped metallic body is retained in a fixture around a bottom dome thereof during expansion of the sidewall.

10. A method as set forth in claim 1 wherein the coil is energized from about 1 to about 4 kilojoule of energy.

11. A method as set forth in claim 1 wherein the expandable metallic body is a predominantly metal material selected from the group consisting of aluminum, steel, tinplate, polymer aluminum laminates, and alloys thereof.

12. A method as set forth in claim 1 wherein the expandable metallic body is an aluminum container body having a wall thickness of from about 0.002 inch to about 0.030 inch.

13. A method as set forth in claim 12 wherein the expandable container body has a diameter of from about 2 to about 3 inches.

14. A method as set forth in claim 1 wherein the coil comprises an electrically conductive wire wrapped around a structural core member, wherein the electrically conductive wire is a material selected from the group consisting of aluminum, copper, iron, mild steel, and alloys thereof.

15. A method as set forth in claim 1 wherein the coil disposed inside the metallic body comprises a generally cylindrical aluminum core having a passageway therein, extending along a central longitudinal axis, an insulating layer around the exterior cylindrical surface of the core, and conductor wire wound over the insulating layer having sufficient turns per unit length to provide magnetic force sufficient to outwardly expand a portion of the sidewall of an adjacent container when energized.

16. A method as set forth in claim 15 wherein the conductor wire is copper.

17. A method as set forth in claim 16 wherein the copper wire has a generally rectangular cross-section.

18. A method as set forth in claim 1 wherein the coil is disposed within 0.050 inch of the surface of the portion of the sidewall to be expanded.

19. An apparatus for outwardly expanding a sidewall of a generally cylindrically shaped portion of an electrically responsive, metallic body, comprising:

means for retaining at least a first portion of the metallic body, a coil of electrically conductive material able to provide electromagnetic force when energized, means for disposing the coil inside the retained metallic body with the outer diameter of the coil adjacent the inside surface of the portion of the sidewall to be expanded, means for energizing the coil to create an electromagnetic force sufficient to expand at least a portion of the sidewall of the metallic body outwardly of the original generally cylindrical shape in an unrestricted area, and means for introducing a fluid between the coil and the inside surfaces of the metallic body during expansion of the sidewall to maintain at least positive gauge pressure throughout expansion of the sidewall.

20. An apparatus as set forth in claim 19 wherein the coil comprises at least one conductor portion having at least one turn.

21. An apparatus as set forth in claim 19 wherein the coil comprises at least two conductor winding portions each having a at least one turn, said conductor winding portions electrically connected to one another by the conductor.

22. An apparatus as set forth in claim 19 wherein the coil comprises a conductor helically wrapped on a structural core member.

23. An apparatus as set forth in claim 19 including means for retaining the metallic body at a first portion substantially around the circumference of the base of the metallic body and at a second portion substantially around the circumference of an upper portion of the metallic body.

24. An apparatus as set forth in claim 19 wherein positive gauge pressure is maintained by introducing a gas between the coil and the inside surfaces of the metallic body at a pressure of at least 70 pounds per square inch.

25. An apparatus as set forth in claim 24 wherein the gas is selected from the group consisting of air, nitrogen, carbon dioxide, argon and helium.

26. An apparatus as set forth in claim 19 wherein positive gauge pressure is maintained by introducing air pressure of from about 90 to 100 pounds per square inch through a longitudinal passage through a central axis of the coil while maintaining a restrictive seal about an open end of the metallic body.

27. An apparatus as set forth in claim 19 including means for retaining the metallic body at a bottom end portion around a bottom dome of a cup-shaped metallic body during expansion of the sidewall.

28. An apparatus as set forth in claim 19 wherein the means for energizing the coil comprises a capacitor power supply energized from about 1 to about 4 kilojoule of energy.

29. An apparatus as set forth in claim 19 wherein the metallic body is a predominantly metal material selected from the group consisting of aluminum, steel, tinplate, polymer aluminum laminates, and alloys thereof.

30. An apparatus as set forth in claim 19 wherein the metallic body is an aluminum container body having a wall thickness of from about 0.002 inch to about 0.030 inch.

31. An apparatus as set forth in claim 30 wherein the container body has a diameter of from about 2 to about 3 inches.

32. An apparatus as set forth in claim 19 wherein the coil comprises an electrically conductive wire wrapped around a structural core member, wherein the electrically conductive wire is a material selected from the group consisting of aluminum, copper, iron, mild steel, and alloys thereof.

33. An apparatus as set forth in claim 19 wherein the coil comprises a generally cylindrical aluminum core having a passageway therein extending along a central longitudinal axis, an insulating layer around the exterior cylindrical surface of the core, and conductor wire wound over the insulating layer having sufficient turns per unit length to provide sufficient magnetic force to outwardly expand a portion of the sidewall of an adjacent container when energized.

34. An apparatus as set forth in claim 33 wherein the conductor wire is copper.

35. An apparatus as set forth in claim 33 wherein the copper wire has a generally rectangular cross-section.

36. An apparatus as set forth in claim 34 wherein the coil is encapsulated in a nonconducting material.

37. An apparatus as set forth in claim 35 wherein the nonconducting material is epoxy.

38. An apparatus as set forth in claim 19 wherein the disposing means positions the coil within 0.050 inch of the surface of the portion of the sidewall to be expanded.

39. A generally cylindrical metallic can body having at least a portion of a sidewall expanded outwardly by the process of:

retaining at least a first portion of the metallic can body, disposing a coil of electrically conductive material inside the metallic can body with the outer diameter of the coil adjacent inside surfaces of a portion of the sidewall to be expanded, energizing the coil to create an electromagnetic force sufficient to expand at least a portion of the sidewall of the metallic can body outwardly of the original generally cylindrical shape in an unrestricted area, and introducing a fluid between the coil and the inside surface of the metallic can body during expansion of the sidewall to maintain at least positive gauge pressure throughout expansion of the sidewall.

40. A can body as set forth in claim 39 wherein the can body is metal selected from the group consisting of aluminum, steel, tinplate, and metal dominant polymer-aluminum laminate, and polymer-steel laminate.

* * * * *